US010365598B2

(12) United States Patent
Ono

(10) Patent No.: US 10,365,598 B2
(45) Date of Patent: Jul. 30, 2019

(54) FIXING DEVICE AND IMAGE FORMING APPARATUS

(71) Applicant: KYOCERA Document Solutions Inc., Osaka (JP)

(72) Inventor: Tomohisa Ono, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/200,688

(22) Filed: Nov. 27, 2018

(65) Prior Publication Data

US 2019/0179244 A1 Jun. 13, 2019

(30) Foreign Application Priority Data

Dec. 8, 2017 (JP) ..... 2017-236038

(51) Int. Cl.
*G03G 15/04* (2006.01)
*G03G 15/20* (2006.01)
*G03G 15/00* (2006.01)

(52) U.S. Cl.
CPC ..... *G03G 15/2064* (2013.01); *G03G 15/2028* (2013.01); *G03G 15/70* (2013.01)

(58) Field of Classification Search
CPC ..... G03G 15/2017; G03G 15/2028; G03G 15/2039; G03G 15/2053; G03G 2215/759; G03G 2215/2003
USPC ..... 399/107, 110, 122, 320, 328–331, 400
See application file for complete search history.

(56) References Cited

U.S. PATENT DOCUMENTS

RE37,157 E * 5/2001 Ikeda ..... G03G 15/22 271/184

FOREIGN PATENT DOCUMENTS

JP H06-011992 A 1/1994

* cited by examiner

*Primary Examiner* — Hoan H Tran
(74) *Attorney, Agent, or Firm* — Studebaker & Brackett PC

(57) ABSTRACT

A fixing device includes a detection device. The detection device includes an actuator and a roller. The roller includes a sheet contact part. The roller is supported by the actuator in a movable manner between a first roller position and a second roller position. When the roller is positioned at the first roller position, the sheet contact part juts out from the actuator as viewed in an axial direction of the roller. When the roller is positioned at the second roller position, the sheet contact part overlaps with the actuator as viewed in the axial direction of the roller.

9 Claims, 8 Drawing Sheets

FIXING DEVICE AND IMAGE FORMING APPARATUS

INCORPORATION BY REFERENCE

The present application claims priority under 35 U.S.C. § 119 to Japanese Patent Application No. 2017-236038, filed on Dec. 8, 2017. The contents of this application are incorporated herein by reference in their entirety.

BACKGROUND

The present disclosure relates to a fixing device and an image forming apparatus.

A fixing device is known that is disposed on a conveyance path of a sheet. The fixing device includes a fixing section for toner image fixing. The fixing section includes a heating roller and a pressure roller. The fixing section allows a transfer sheet to enter a nip part formed between the heating roller and the pressure roller and fixes a toner image to the transfer sheet.

SUMMARY

According to an aspect of the present disclosure, a fixing device includes a fixing section and a detection section. A sheet is conveyed to the fixing section. The fixing section fixes a toner image formed on the sheet to the sheet. The detection section detects presence of the sheet in the fixing section. The detection device includes an actuator and a roller. The actuator is supported in a movable manner between a first detection position and a second detection position. The roller is supported by the actuator in a rotatable manner. The actuator is located across a conveyance path of the sheet while positioned at the first detection position. When the sheet reaches the actuator positioned at the first detection position, the actuator moves to the second detection position. The roller includes a sheet contact part. The sheet contact part comes into contact with the sheet being conveyed. The roller is supported by the actuator in a movable manner between a first roller position and a second roller position. When the roller is positioned at the first roller position, the sheet contact part juts out from the actuator as viewed in an axial direction of the roller. When the roller is positioned at the second roller position, the sheet contact part overlaps with the actuator as viewed from the axial direction of the roller.

According to another aspect of the present disclosure, an image forming apparatus includes the above fixing device and an image forming section. The image forming section forms the toner image on the sheet.

DETAILED DESCRIPTION

Figure 1:
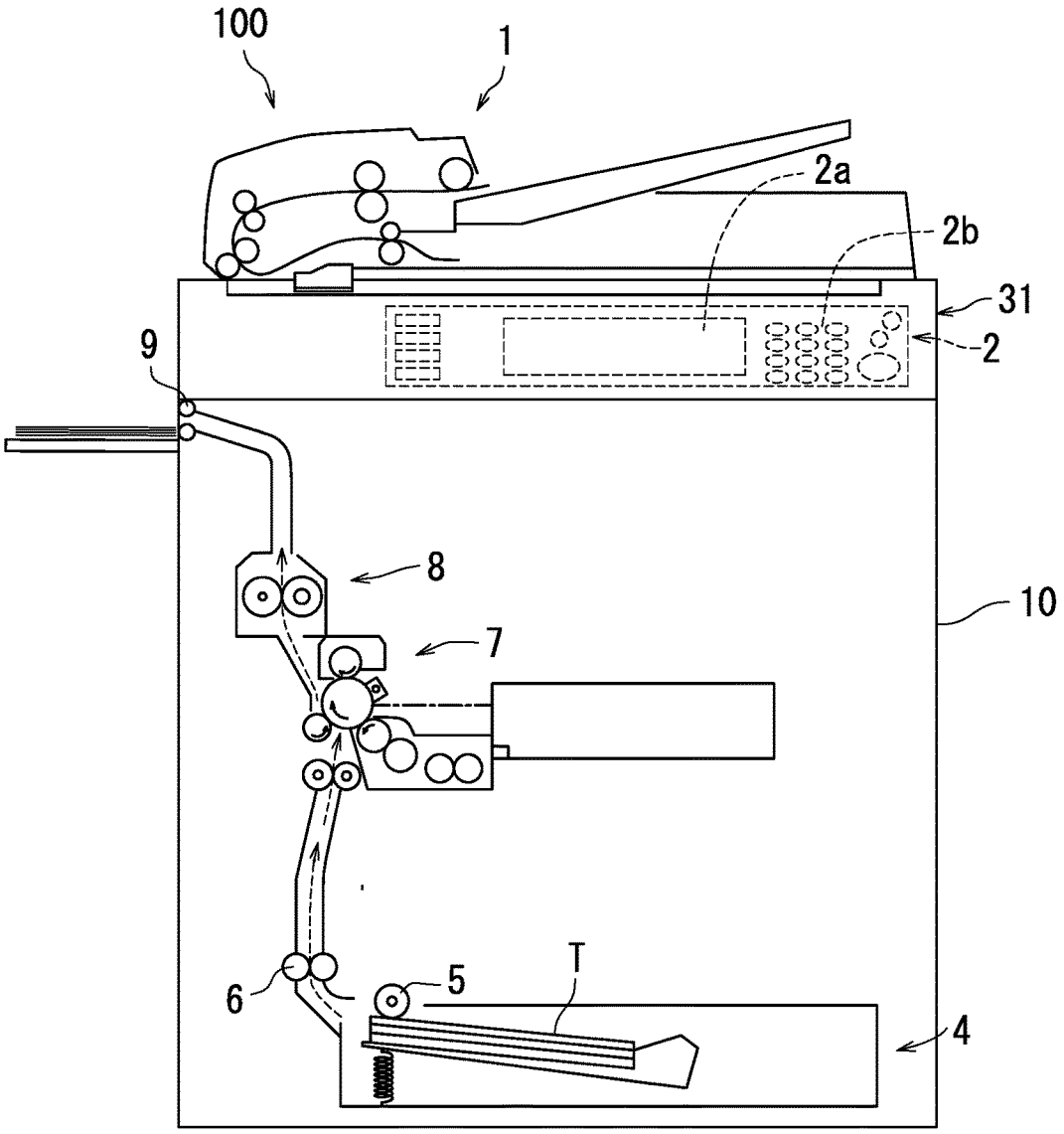
FIG. 1 is a schematic cross-sectional view of an image forming apparatus according to an embodiment of the present disclosure.

An embodiment of the present disclosure will be described below with reference to accompanying drawings. Note that elements that are the same or equivalent are indicated by the same reference signs in the drawings and explanation thereof is not repeated.

The following describes an image forming apparatus 100 according to the embodiment of the present disclosure with reference to FIG. 1. FIG. 1 is a schematic cross-sectional view illustrating the image forming apparatus 100.

As illustrated in FIG. 1, the image forming apparatus 100 includes a conveyance section 1, an input section 2, a scanner 3, a cassette 4, a pickup roller 5, a conveyance roller 6, an image forming section 7, a fixing device 8, an ejection roller 9, and a first casing 10.

The conveyance section 1 conveys a document to the scanner 3. The scanner 3 scans an image of the document to acquire image data. The scanner 3 includes for example a light emitting element such as light emitting diodes (LEDs) and an imaging section such as an image sensor. The scanner 3 scans the image of the document using the light emitting element and the imaging section.

The input section 2 includes a display section 2*a* and an operation key set 2*b*. The input section 2 receives a user instruction to the image forming apparatus 100. The display section 2*a* functions for example as a touch panel.

The cassette 4 accommodates sheets T. Examples of the sheets T include plain paper, copy paper, recycled paper, thin paper, thick paper, glossy paper, and an overhead projector (OHP) sheet. The pickup roller 5 picks up a sheet T accommodated in the cassette 4 and feeds the sheet T out of the cassette 4. The conveyance roller 6 conveys the sheet T fed by the pickup roller 5 to the image forming section 7.

The image forming section 7 forms a toner image on the sheet T. The image forming section 7 includes a photosensitive drum, a charger, a light exposure section, a development section, a transfer section, a cleaner, and a static eliminator. The photosensitive drum, the charger, the light exposure section, the development section, and the transfer section operate to form the toner image on the sheet T. The cleaner removes toner remaining on a surface of the photosensitive drum. The static eliminator removes residual charge on the surface of the photosensitive drum. The image forming section 7 forms the toner image on the sheet T, and then feeds the sheet T to the fixing device 8. The fixing device 8 fixes the toner image to the sheet T by applying heat and pressure.

The ejection roller 9 ejects the sheet T having passed through the fixing device 8 out of the first casing 10.

The first casing 10 accommodates the cassette 4, the pickup roller 5, the conveyance roller 6, the image forming section 7, the fixing device 8, and the ejection roller 9.

Figure 2:
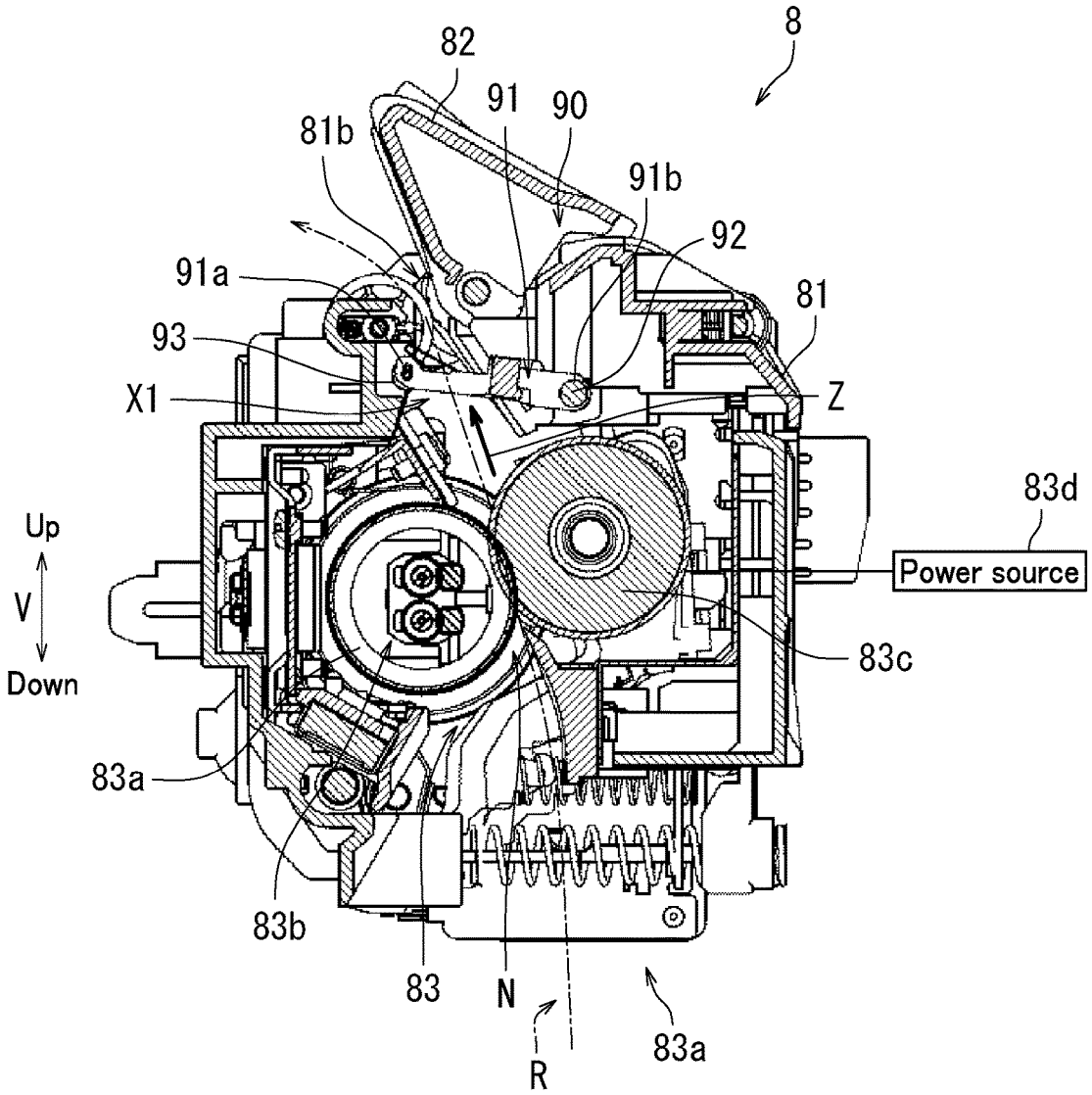
FIG. 2 is a schematic cross-sectional view of a fixing device.

The following describes the fixing device 8 with reference to FIG. 2. FIG. 2 is a schematic cross-sectional view of the fixing device 8.

As illustrated in FIG. 2, the fixing device 8 includes a second casing 81, a cover 82, and a fixing section 83.

The second casing 81 accommodates a fixing roller 83*a* and a pressure roller 83*c*. An opening 81*a* is formed in a lower part of the second casing 81. The cover 82 is disposed on the second casing 81 to cover the second casing 81 from above. A slit 81*b* is formed between the cover 82 and the second casing 81.

The fixing section 83 fixes the toner image formed on the sheet T to the sheet T. The fixing section 83 includes the fixing roller 83*a*, a heat source 83*b*, the pressure roller 83*c*, and a power source 83*d*.

The fixing roller 83*a* is supported by the second casing 81 in a rotatable manner. The heat source 83*b* heats the fixing roller 83*a*. The heat source 83*b* includes for example a halogen lamp or a xenon lamp. The pressure roller 83*c* is supported by the second casing 81 in a rotatable manner. The pressure roller 83*c* is in contact with the fixing roller 83*a*. A nip part N is formed at a location where the pressure roller 83*c* and the fixing roller 83*a* are in contact with each other. The power source 83*d* rotates one of the fixing roller 83*a* and the pressure roller 83*c*. The power source 83*d* rotates the fixing roller 83*a* in the present embodiment. In the above configuration, the pressure roller 83*c* is rotated along with rotation of the fixing roller 83*a* in the present embodiment. The power source 83*d* includes for example a motor and a gear.

When the power source 83*d* rotates the fixing roller 83*a*, the fixing roller 83*a* and the pressure roller 83*c* rotate while holding the sheet T at the nip part N. The sheet T is heated by heat of the heat source 83*b* during the time when the sheet T passes through the nip part N. As a result, the toner image is fixed to the sheet T.

The fixing device 8 further includes a detection device 90. The detection device 90 detects the presence of the sheet T in the fixing section 83. The detection device 90 is disposed downstream of the fixing section 83 in terms of a conveyance direction Z of the sheet T. The detection device 90 includes an actuator 91, a support shaft 92, and a roller 93.

The actuator 91 is for example made from resin. The actuator 91 is disposed above the fixing roller 83*a* and the pressure roller 83*c* in an up-down direction V. The actuator 91 has a tip end 91*a* and a base end 91*b*. The tip end 91*a* turns about the base end 91*b* as a center.

The support shaft 92 is mounted on the second casing 81. The support shaft 92 is supported by the second casing 81. The support shaft 92 is inserted through the base end 91*b* of the actuator 91.

The actuator 91 is mounted to the support shaft 92 in a rotatable manner. The actuator 91 is supported by the second casing 81 through the support shaft 92. The actuator 91 pivots about an axis of the support shaft 92. The tip end 91*a* of the actuator 91 turns about the support shaft 92 as a center.

The roller 93 is mounted on the actuator 91 in a rotatable manner. Specifically, the roller 93 is mounted on the tip end 91*a* of the actuator 91 in a rotatable manner.

A sheet conveyance path R in FIG. 2 indicates a sheet conveyance path along which the sheet T passes through the fixing device 8. As illustrated in FIG. 2, the sheet T with the toner image formed thereon is conveyed along the sheet conveyance path R. Specifically, the sheet T with the toner image formed thereon enters the second casing 81 through the opening 81*a*. The sheet T then passes through the nip part N and is fed out of the second casing 81 through the slit 81*b*.

The actuator 91 is supported in a movable manner between a first detection position X1 and a second detection position X2. Specifically, the actuator 91 is supported to be movable between the first detection position X1 and the second detection position X2 by pivoting about the base end 91*b* as an axis.

The following describes the first detection position X1 with reference to FIG. 2. FIG. 2 illustrates the actuator 91 in the first detection position X1.

As illustrated in FIG. 2, the actuator 91 is located across the sheet conveyance path R while positioned at the first detection position X1. The actuator 91 is positioned at the first detection position X1 during the time when the sheet T is not passing through the fixing device 8. During the time when the sheet T is passing through the fixing device 8, the sheet T is conveyed along the sheet conveyance path R while in contact with the actuator 91. During the time when the sheet T is passing through the fixing device 8, the sheet T pushes the actuator 91 from below in the up-down direction V. In the above configuration, the actuator 91 is moved to the second detection position X2 by pressure from the conveyed sheet T. That is, upon the sheet T reaching the actuator 91 in the first detection position X1, the actuator 91 is moved to the second detection position X2.

Figure 3:
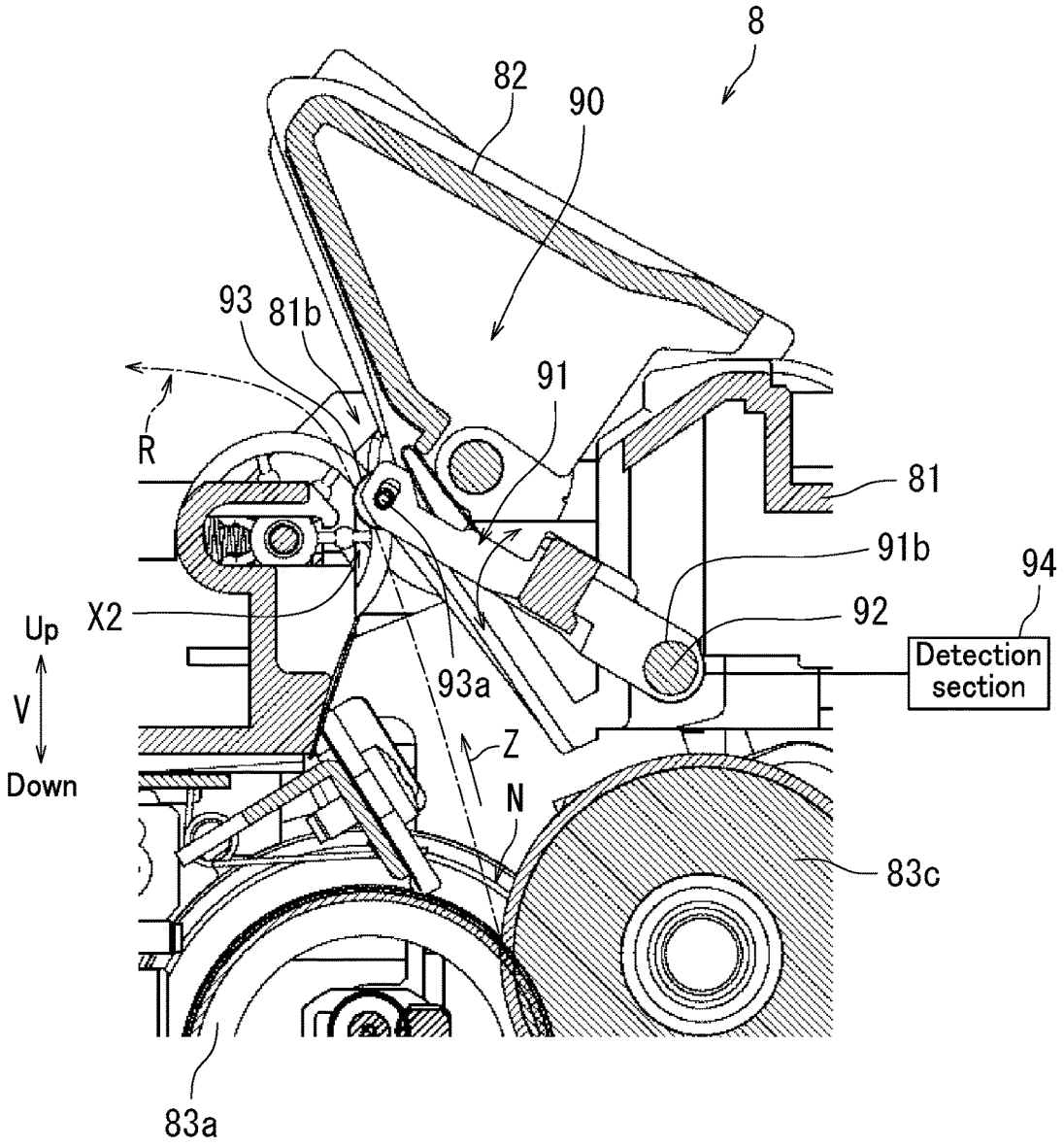
FIG. 3 is a diagram illustrating an actuator positioned at a second detection position.

The following describes the second detection position X2 with reference to FIGS. 2 and 3. FIG. 3 illustrates the actuator 91 positioned at the second detection position X2.

As illustrated in FIGS. 2 and 3, the tip end 91*a* of the actuator 91 is located higher in the up-down direction V when the actuator 91 is positioned at the second detection position X2 than when the actuator 91 is positioned at the first detection position X1. The second detection position X2 is accordingly located more upward than the first detection position X1 in the up-down direction V.

An axis 93*a* in FIG. 3 indicates a rotational axis of the roller 93. The roller 93 rotates about the axis 93*a*. The axis 93*a* of the roller 93 extends in a direction perpendicular to the conveyance direction Z of the sheet T. The axis 93*a* of the roller 93 extends in a direction perpendicular to the drawing surface of FIG. 3 in the present embodiment.

While positioned at the second detection position X2, the actuator 91 is not located across the sheet conveyance path R but is located apart from the sheet conveyance path R, as illustrated in FIG. 3. In the above configuration, the conveyed sheet T is in contact with the roller 93 while out of contact with the actuator 91 in a state in which the actuator 91 is positioned at the second detection position X2. As a result, abrasion of the actuator 91 through contact with the conveyed sheet T pressing the actuator 91 can be inhibited. Furthermore, toner of the toner image formed on the sheet T can be inhibited from adhering to the actuator 91. Note that the term conveyed sheet T refers to a sheet T being conveyed along the sheet conveyance path R.

The detection device 90 further includes a detection section 94. The detection section 94 detects that the actuator 91 is positioned at the second detection position X2.

The detection section 94 includes for example a light emitter and a light receiver. The light emitter emits light toward the light receiver. The light from the light emitter is not blocked by the actuator 91 when the actuator 91 is positioned at the first detection position X1. By contrast, when the actuator 91 is positioned at the second detection position X2, the light from the light emitter is blocked by the actuator 91 and the light receiver does not receive the light from the light emitter. Accordingly, when the light receiver does not receive the light from the light emitter, the detection section 94 detects that the actuator 91 is positioned at the second detection position X2. That the detection section 94 detects that the actuator 91 is positioned at the second detection position X2 means that the detection section 94 detects the presence of the sheet T in the fixing section 83. When the light receiver receives the light from the light emitter, the detection section 94 detects that the actuator 91 is positioned at the first detection position X1. That the detection section 94 detects that the actuator 91 is positioned at the first detection position X1 means that the detection section 94 detects absence of the sheet T from the fixing section 83.

Note that the actuator 91 may block the light from the light emitter when the actuator 91 is positioned at the first detection position X1. In this case, when the actuator 91 is positioned at the second detection position X2, the light from the light emitter is not blocked by the actuator 91 and the light receiver receives the light from the light emitter. Accordingly, the detection section 94 detects that the actuator 91 is positioned at the second detection position X2 when the light receiver receives the light from the light emitter. The detection section 94 detects that the actuator 91 is positioned at the first detection position X1 when the light receiver does not receive the light from the light emitter.

The detection section 94 is not limited to including the light emitter and the light receiver. The detection section 94 may detect that the actuator 91 is positioned at the second detection position X2 for example using a touch sensor. In the above case, the actuator 91 comes into contact with the touch sensor upon being positioned at the second detection position X2. The detection section 94 accordingly detects that the actuator 91 is positioned at the second detection position X2.

When the sheet T is present in the fixing section 83, the actuator 91 is positioned at the second detection position X2. The workings thereof are that when the sheet T is present in the fixing section 83, the actuator 91 receives pressure from the sheet T to be moved to the second detection position X2. By contrast, when the sheet T is absent from the fixing section 83, no pressure is applied from the sheet T to the actuator 91, and therefore, the actuator 91 remains positioned at the first detection position X1. In the above configuration, the detection section 94 detects that the sheet T is present in the fixing section 83 through detecting that the actuator 91 is positioned at the second detection position X2.

Figure 4:
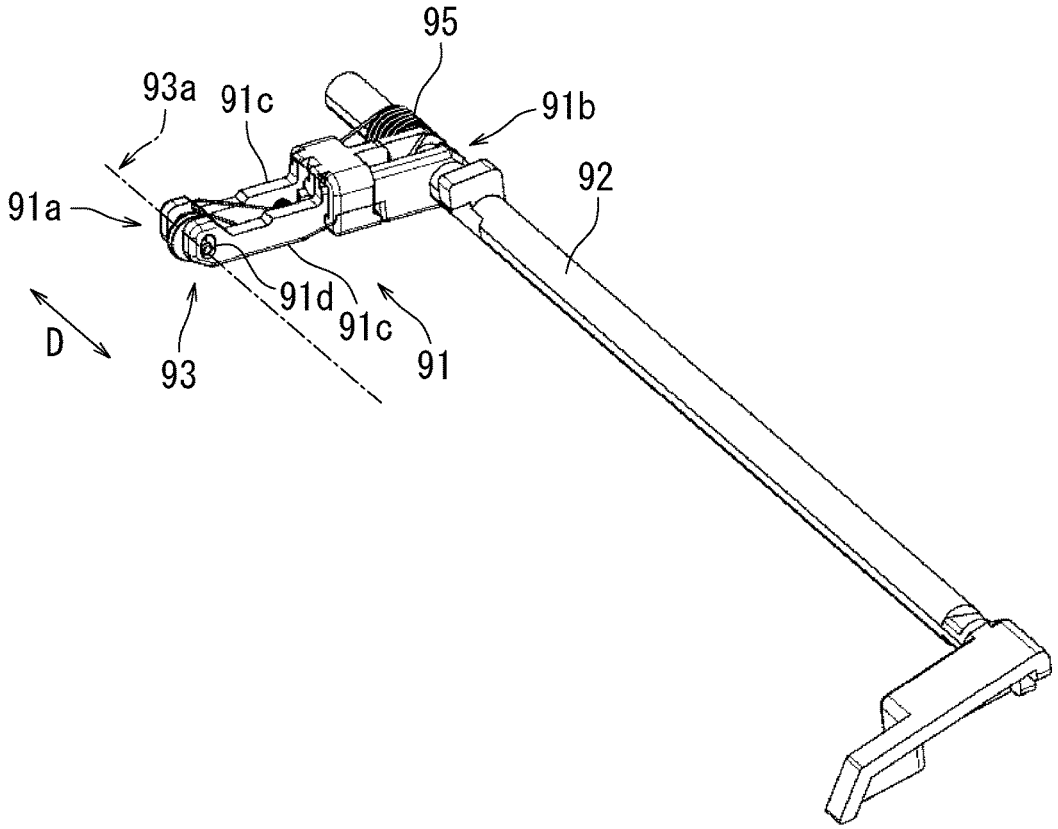
FIG. 4 is a perspective view illustrating the actuator mounted on a support shaft.
Figure 5A:
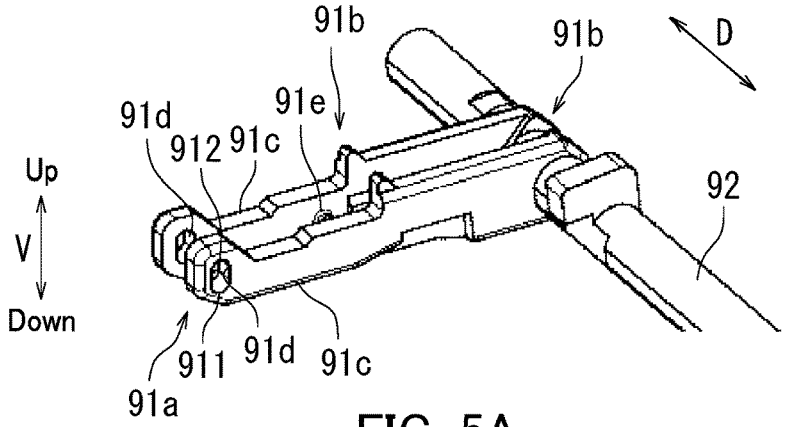
FIG. 5A is a perspective view of the actuator.
Figure 5B:
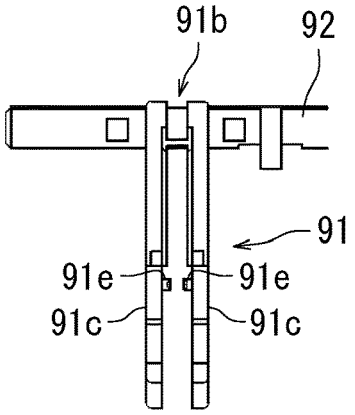
FIG. 5B is a diagram of the actuator as viewed from above in an up-down direction.

The following describes the actuator 91 with reference to FIGS. 4, 5A, and 5B. FIG. 4 is a perspective view illustrating the actuator 91 mounted on the support shaft 92. FIG. 5A is a perspective view of the actuator 91. FIG. 5B is a diagram illustrating the actuator 91 as viewed from above in the up-down direction V.

As illustrated in FIG. 4, the detection device 90 further includes a spring 95. The spring 95 urges the actuator 91 toward the first detection position X1 (see FIG. 2). The spring 95 is for example a torsion coil spring. The spring 95 is mounted on the actuator 91 and the support shaft 92. The spring 95 urges the actuator 91 to position the actuator 91 at the first detection position X1 when the sheet T is absent from the fixing section 83.

As illustrated in FIGS. 4 and 5A, the actuator 91 includes paired opposite portions 91*c*. The paired opposite portions 91*c* are spaced apart from each other in an axial direction D of the roller 93. The axial direction D of the roller 93 is a direction in which the axis 93*a* of the roller 93 extends. The paired opposite portions 91*c* are located close to the tip end 91*a* of the actuator 91. The roller 93 is disposed between the paired opposite portions 91*c*.

As illustrated in FIG. 5A, the actuator 91 has long holes 91*d*. The long holes 91*d* pass through the actuator 91 in the axial direction D, specifically, the respective opposite portions 91*c* of the actuator 91. The long hole 91*d* extends substantially in the up-down direction V. The long hole 91*d* includes a first long hole end 911 and a second long hole end 912. The first long hole end 911 is a lower end of the long hole 91*d*. The second long hole end 912 is an upper end of the long hole 91*d*. The long holes 91*d* are paired. The paired long holes 91*d* are formed in the respective paired opposite portions 91*c*. The paired long holes 91*d* are spaced apart from each other in the axial direction D.

As illustrated in FIGS. 5A and 5B, the actuator 91 further includes paired protruding portions 91*e*. The paired protruding portions 91*e* are secured to the respective paired opposite portions 91*c*. The paired protruding portions 91*e* are located between the paired opposite portions 91*c* and protrude toward each other. The paired protruding portions 91*e* are located closer to the base end 91*b* of the actuator 91 than to the paired long holes 91*d*.

Figure 5C:
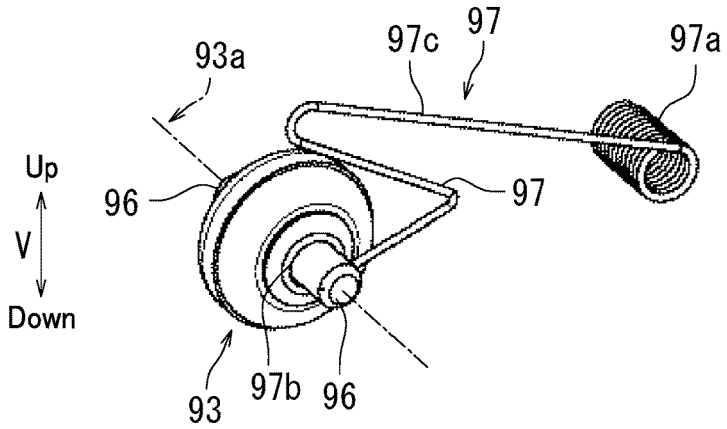
FIG. 5C is a perspective view of a roller.

The following describes a configuration to support the roller 93 with reference to FIGS. 5A to 5C. FIG. 5C is a perspective view of the roller 93.

As illustrated in FIG. 5C, the detection device 90 further includes paired shaft members 96. The paired shaft members 96 extend along the axis 93*a* of the roller 93.

The paired shaft members 96 are provided on the roller 93. The paired shaft members 96 are secured to the roller 93. The paired shaft members 96 protrude from the roller 93 in respective directions opposite to each other.

As illustrated in FIGS. 5A and 5C, the paired shaft members 96 are inserted in the respective paired long holes 91*d*. In the above configuration, the roller 93 is supported by the actuator 91 through the paired shaft members 96.

The roller 93 located between the paired opposite portions 91*c* moves between a first roller position Y1 and a second roller position Y2. The roller 93 rotates between the paired opposite portions 91*c*.

As illustrated in FIG. 5C, the detection device 90 further includes an urging member 97. The urging member 97 urges the roller 93. The urging member 97 is made from a resiliently deformable material. The urging member 97 is for example made from a metal material. The urging member 97 has a first mount end 97*a*, a second mount end 97*b*, an extension portion 97*c*, and a bent portion 97*d*.

The extension portion 97*c* is located between the first and second mount ends 97*a* and 97*b*. The extension portion 97*c* extends from the first mount end 97*a* toward the roller 93. The extension portion 97*c* extends above the roller 93 from the first mount end 97*a* in the present embodiment. The bent portion 97*d* is located between the extension portion 97*c* and the second mount end 97*b*. The bent portion 97*d* extends from the extension portion 97*c* to the second mount end 97*b* while being bent at least one time. The bent portion 97*d* is bent two times in the present embodiment. The bent portion 97*d* being bent as above can avoid interference of the urging member 97 with the roller 93 and allow the extension portion 97*c* to extend above the roller 93.

As illustrated in FIGS. 5B and 5C, the urging member 97 is mounted on the actuator 91 and the roller 93. The first mount end 97*a* is in the form of a coil. The paired protruding portions 91*e* are inserted in the first mount end 97*a*. In the above configuration, the first mount end 97*a* is mounted on the actuator 91 through the paired protruding portions 91*e*.

The second mount end 97*b* is wound around one of the paired shaft members 96. In the above configuration, the second mount end 97*b* is mounted on the roller 93 through the one of the paired shaft members 96.

Figure 6A:
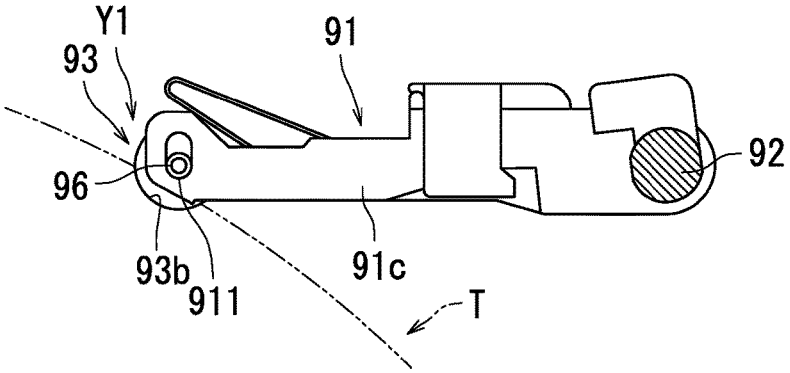
FIG. 6A is a diagram illustrating the roller positioned at a first roller position.
Figure 6B:
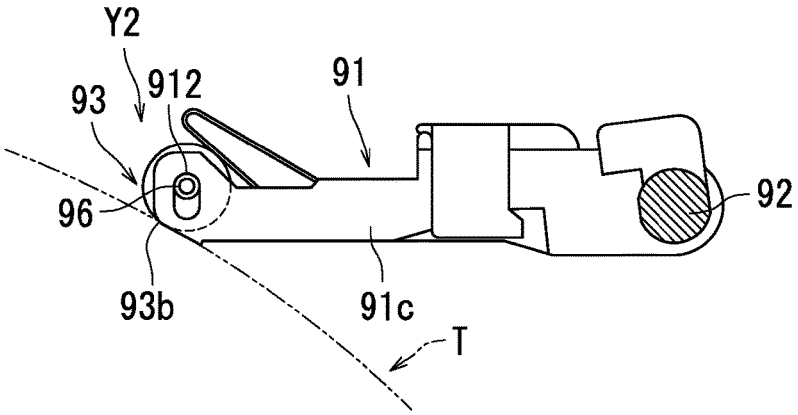
FIG. 6B is a diagram illustrating the roller positioned at a second roller position.

The following describes operation of the roller 93 with reference to FIGS. 6A and 6B. FIGS. 6A and 6B are diagrams each illustrating the roller 93 as viewed in the axial direction D. In FIGS. 6A and 6B, the axial direction D is a direction perpendicular to the drawing surface thereof.

In FIG. 6A, the roller 93 is positioned at the first roller position Y1.

As illustrated in FIG. 6A, when the shaft members 96 are located at the first long hole ends 911, the roller 93 is positioned at the first roller position Y1. When the roller 93 is positioned at the first roller position Y1, a sheet contact part 93*b* juts out from the actuator 91 as viewed in the axial direction D of the roller 93. When the roller 93 is positioned at the first roller position Y1, the sheet contact part 93*b* juts out from between the paired opposite portions 91*c* in the present embodiment. The sheet contact part 93*b* is a part of the roller 93 that comes into contact with the conveyed sheet T. The sheet contact part 93*b* is a part of an outer circumferential surface of the roller 93.

In FIG. 6B, the roller 93 is positioned at the second roller position Y2.

As illustrated in FIG. 6B, when the shaft members 96 are located at the second long hole ends 912, the roller 93 is positioned at the second roller position Y2. When the roller 93 is positioned at the second roller position Y2, the sheet contact part 93*b* overlaps with the actuator 91 as viewed in the axial direction D of the roller 93. When the roller 93 is positioned at the second roller position Y2, the sheet contact part 93*b* is hidden in the actuator 91 as viewed in the axial direction D of the roller 93 in the present embodiment. Furthermore, when the roller 93 is positioned at the second roller position Y2, the sheet contact part 93*b* is located between the paired opposite portions 91*c* in the present embodiment. In the above configuration, the sheet T can be brought into contact with a first part of the actuator 91 when the roller 93 is positioned at the second roller position Y2. The first part is a part of the actuator 91 at which the roller 93 is located.

The first part can be abraded by bringing the sheet T into contact with the first part. Accordingly, the first part and a second part that is a part of the actuator 91 located around the first part are abraded by the sheet T, with a result that formation of a step between the first and second parts can be inhibited. Thus, jam occurrence can be prevented.

As illustrated in FIGS. 6A and 6B, the roller 93 is supported by the actuator 91 in a movable manner between the first and second roller positions Y1 and Y2. The shaft members 96 slide in the long holes 91*d* to move the roller 93 between the first and second roller positions Y1 and Y2.

Figure 7A:
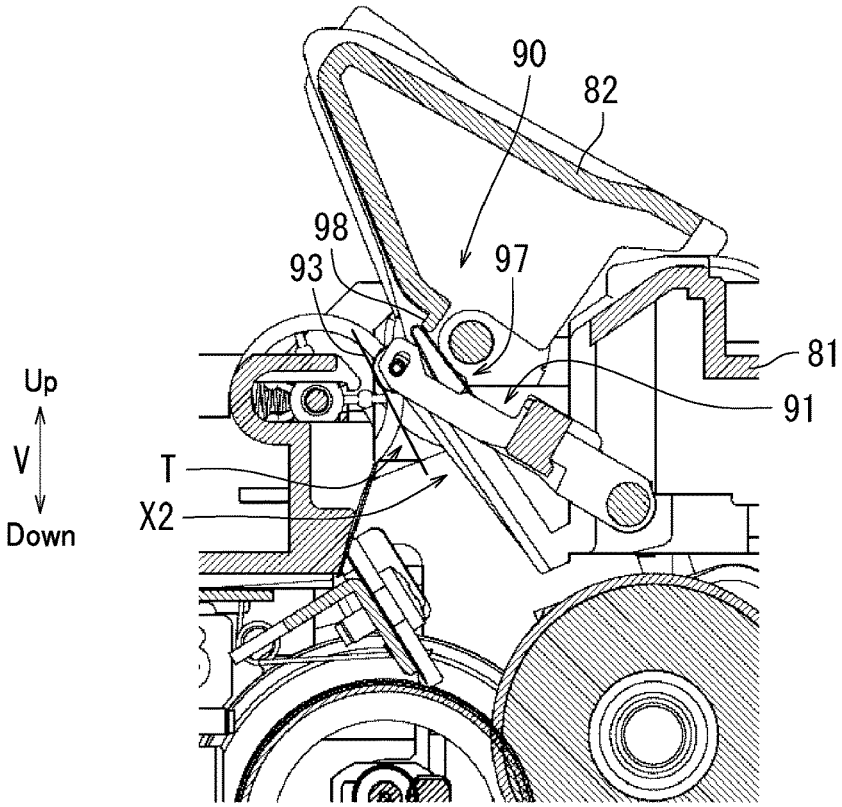
FIG. 7A is a schematic cross-sectional view illustrating a state in which an urging member urges the roller.
Figure 7B:
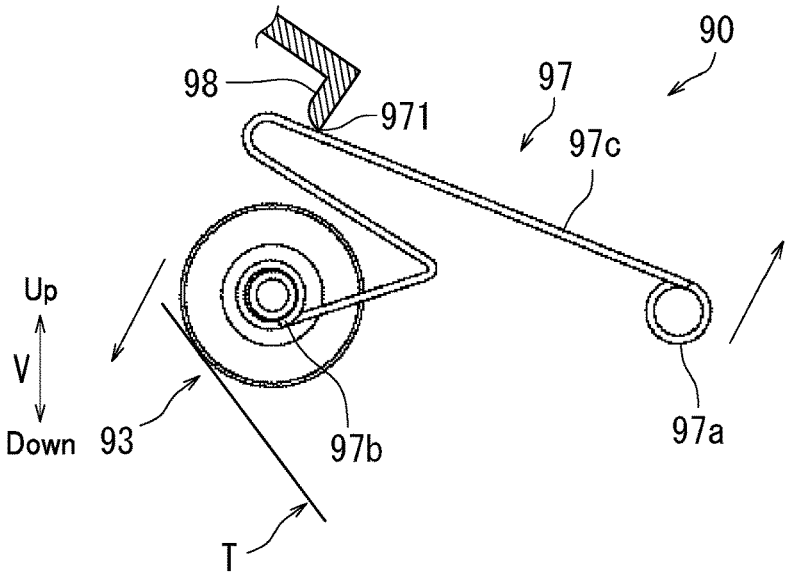
FIG. 7B is an enlarged view illustrating the state in which the urging member urges the roller.

The following describes operation of the urging member 97 with reference to FIGS. 7A and 7B. FIG. 7A is a schematic cross-sectional view illustrating a state in which the urging member 97 urges the roller 93. FIG. 7B is an enlarged view illustrating a state in which the urging member 97 urges the roller 93.

As illustrated in FIGS. 7A and 7B, the detection device 90 further includes a contact portion 98. The contact portion 98 is for example a protrusion formed on the cover 82. Alternatively, the contact portion 98 may be formed on the second casing 81.

The contact portion 98 is positioned at a location that comes in contact with the urging member 97 when the actuator 91 is positioned at the second detection position X2. When the actuator 91 is positioned at the second detection position X2, the contact portion 98 is in contact with a specific part 971 of the extension portion 97*c* that is located close to the roller 93.

When the urging member 97 is in contact with the contact portion 98, the urging member 97 urges the roller 93 toward the first roller position Y1. In other words, the urging member 97 urges the roller 93 toward the first roller position Y1 when the actuator 91 is positioned at the second detection position X2. As a result, the roller 93 is positioned at the first roller position Y1 while the actuator 91 is positioned at the second detection position X2. The following describes operation of the urging member 97 to position the roller 93 to the first roller position Y1.

When the contact portion 98 comes into contact with the specific part 971 of the extension portion 97*c*, the specific part 971 is pushed by the contact portion 98. When the specific part 971 is pushed, the urging member 97 is resiliently deformed. Resilient force of the urging member 97 accordingly urges the second mount end 97*b* downward in the up-down direction V. When the second mount end 97*b* is urged downward in the up-down direction V, the roller 93 is urged downward in the up-down direction V. As a result, the roller 93 is moved against pressure from the sheet T to be positioned at the first roller position Y1.

Also, the resilient force of the urging member 97 urges the first mount end 97*a* upward in the up-down direction V. When the first mount end 97*a* is urged upward in the up-down direction V, the actuator 91 is urged toward the second detection position X2. That is, the urging member 97 urges the actuator 91 toward the second detection position X2 while urging the roller 93 toward the first roller position Y1. In the above configuration, it can be further ensured by providing the urging member 97 that the actuator 91 is positioned at the second detection position X2 and the roller 93 is positioned at the first roller position Y1. Furthermore, the roller 93 can be positioned at the first roller position Y1 by resilient force of the urging member 97 even without a power source such as a motor. Accordingly, it is possible with a simple device configuration that the actuator 91 is positioned at the second detection position X2 while the roller 93 is positioned at the first roller position Y1.

Figure 8A:
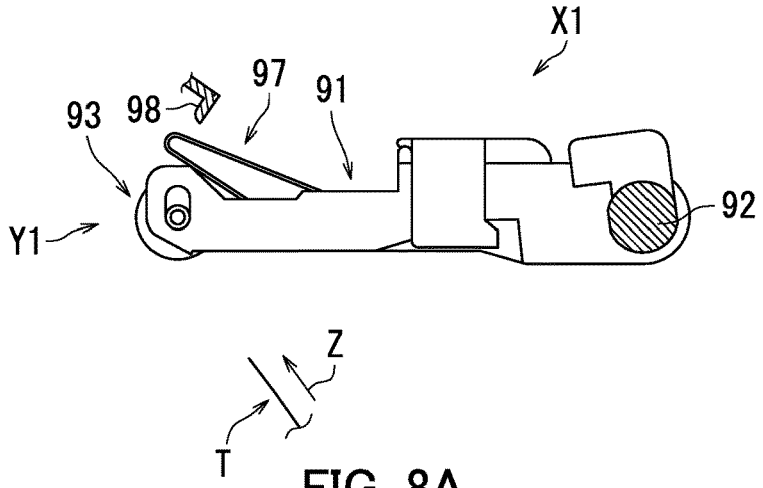
FIG. 8A is a diagram illustrating the actuator positioned at a first detection position.
Figure 8B:
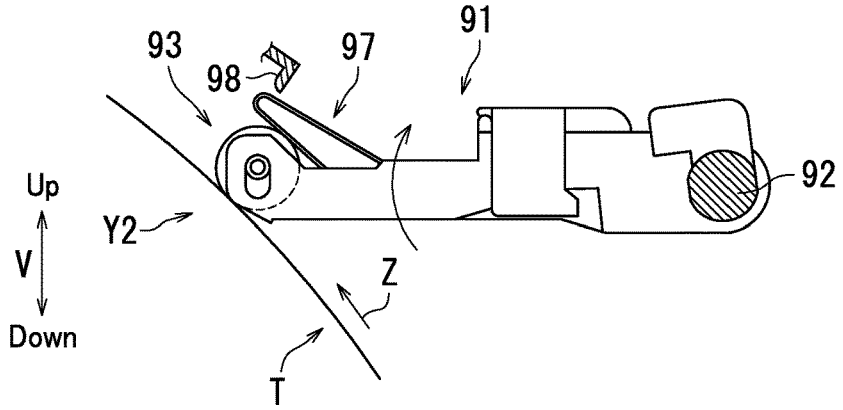
FIG. 8B is a diagram illustrating the actuator moving from the first detection position toward the second detection position.
Figure 8C:
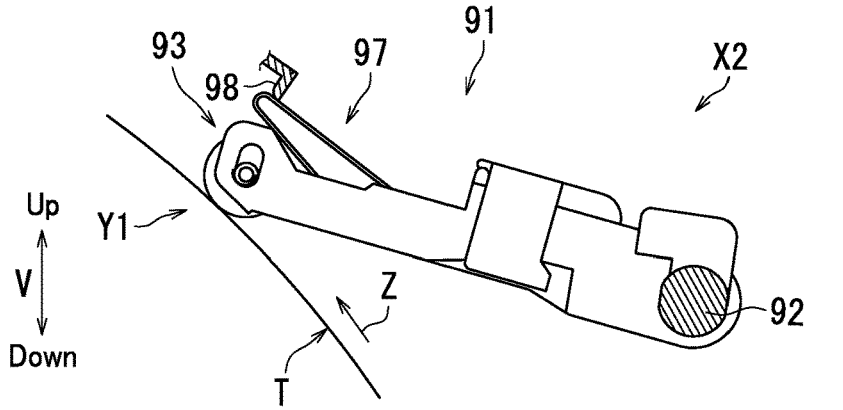
FIG. 8C is a diagram illustrating the actuator positioned at the second detection position.

The following describes operations of the actuator 91 and the roller 93 during the time when the sheet T is passing through the fixing device 8 with reference to FIGS. 8A to 8C.

FIG. 8A is a diagram illustrating the actuator 91 positioned at the first detection position X1.

As illustrated in FIG. 8A, the actuator 91 is positioned at the first detection position X1 while the roller 93 is positioned at the first roller position Y1 before the sheet T reaches the actuator 91. The state in which the sheet T does not yet reach the actuator 91 means a state in which the sheet T is located upstream of the actuator 91 in the conveyance direction Z. Note that the urging member 97 is not resiliently deformed and does not generate resilient force in the above state.

In a state in which the sheet T does not yet reach the actuator 91, the roller 93 is located at the first roller position Y1 by its own weight.

FIG. 8B is a diagram illustrating the actuator 91 moving from the first detection position X1 toward the second detection position X2.

Upon reaching the actuator 91, the sheet T comes into contact with the actuator 91, as illustrated in FIG. 8B. When the sheet T comes into contact with the actuator 91, the actuator 91 receives pressure from the sheet T. Upon receiving pressure from the sheet T, the actuator 91 is moved from the first detection position X1 to the second detection position X2. Specifically, the actuator 91 pivots about the axis of the support shaft 92 upward in the up-down direction V.

Furthermore, when the sheet T reaches the actuator 91, the sheet T comes into contact with the roller 93. Upon the sheet T coming into contact with the roller 93, the roller 93 receives pressure from the sheet T. The roller 93 receiving pressure from the sheet T moves from the first roller position Y1 to the second roller position Y2. Thus, when the sheet T reaches the actuator 91, the actuator 91 moves to the second detection position X2 while the roller 93 is positioned at the second roller position Y2. The first part and the second part of the actuator 91 are accordingly abraded by the sheet T, with a result that formation of a step between the first and second parts can be inhibited. Thus, jam occurrence can be prevented.

FIG. 8C is a diagram illustrating the actuator 91 positioned at the second detection position X2.

As illustrated in FIG. 8C, the actuator 91 is moved by pressure from the sheet T to reach the second detection position X2. The actuator 91 is positioned at the second detection position X2 until the sheet T entirely passes through the actuator 91.

When the actuator 91 reaches the second detection position X2, the urging member 97 comes into contact with the contact portion 98. Contact of the urging member 97 with the contact portion 98 causes resilient deformation of the urging member 97. Resilient deformation of the urging member 97 generates resilient force in the urging member 97 to move the roller 93 from the second roller position Y2 to the first roller position Y1. As a result, the roller 93 rotates while in contact with the sheet T in a state in which the actuator 91 is positioned at the second detection position X2 and the roller 93 is positioned at the first roller position Y1. In the above state, the sheet T is out of contact with the actuator 91. Thus, abrasion of the actuator 91 due to pressure application from the conveyed sheet T can be inhibited. Furthermore, adhesion of toner of the toner image formed on the sheet T to the actuator 91 can be inhibited.

An embodiment of the present disclosure has been described so far with reference to the drawings (FIGS. 1 to 8C). However, the present disclosure is not limited to the above embodiment and can be implemented in various different forms that do not deviate from the essence of the present disclosure (for example, as described below in sections (1) and (2)). Elements of configuration disclosed in the above embodiment can be combined as appropriate in various different forms. Some of the elements of configuration indicated in the embodiment may be omitted. The drawings schematically illustrate elements of configuration in order to facilitate understanding. The number and the like of the elements of configuration illustrated in the drawings may differ from reality in order to aid preparation of the drawings. The elements of configuration indicated in the above embodiment are merely examples that do not impose any particular limitations and can be altered in various ways to the extent that there is not substantial deviation from the effects of the present disclosure.

(1) The image forming section 7 forms monochrome toner images in the present embodiment, which however should not be taken to limit the present disclosure. The image forming section 7 may form color toner images with a plurality of color toners. In the above case, the image forming section 7 may be a tandem image forming section including a plurality of photosensitive drums or a rotary image forming section including a single photosensitive drum. Furthermore, the image forming section 7 may include nozzles to eject ink for image formation onto the sheet T. In the above case, the image is an ink image.

(2) The actuator 91 is positioned at the first detection position X1 while the roller 93 is positioned at the first roller position Y1 until the sheet T reaches the actuator 91 in the present embodiment, which however should not be taken to limit the present embodiment. It is possible that the actuator 91 is positioned at the first detection position X1 while the roller 93 is positioned at the second roller position Y2 until the sheet T reaches the actuator 91. In the above case, for example, the urging member 97 is configured to exert resilient force on the roller 93 to move the roller 93 toward the second roller position Y2 when the sheet T does not yet reach the actuator 91.

What is claimed is:

1. A fixing device comprising:

a fixing section to which a sheet is conveyed and that is configured to fix a toner image formed on the sheet to the sheet; and a detection section configured to detect presence of the sheet in the fixing section, wherein the detection section includes:

an actuator supported in a movable manner between a first detection position and a second detection position; and a roller supported by the actuator in a rotatable manner, the actuator is located across a conveyance path of the sheet while positioned at the first detection position, when the sheet reaches the actuator positioned at the first detection position, the actuator moves to the second detection position, the roller includes a sheet contact part that comes into contact with the sheet being conveyed, the roller is supported by the actuator in a movable manner between a first roller position and a second roller position, when the roller is positioned at the first roller position, the sheet contact part juts out from the actuator as viewed from an axial direction of the roller, and when the roller is positioned at the second roller position, the sheet contact part overlaps with the actuator as viewed from the axial direction of the roller.

2. The fixing device according to claim 1, wherein when the sheet reaches the actuator positioned at the first detection position, the roller moves from the first roller position to the second roller position.

3. The fixing device according to claim 1, wherein the roller is positioned at the second roller position during movement of the actuator toward the second detection position.

4. The fixing device according to claim 1, wherein the roller is positioned at the first roller position while the actuator is positioned at the second detection position.

5. The fixing device according to claim 1, wherein the detection device further includes an urging member that urges the roller toward the first roller position while the actuator is positioned at the second detection position.

6. The fixing device according to claim 5, wherein the detection device further includes a contact portion that comes in contact with the urging member when the actuator is positioned at the second detection position, and the urging member is mounted on the actuator and the roller, and urges the roller toward the first roller position upon coming into contact with the contact portion.

7. The fixing device according to claim 1, wherein the actuator has a long hole, the roller is provided with a shaft member extending along an axis of the roller, and the shaft member is disposed in the long hole.

8. The fixing device according to claim 7, wherein the shaft member slides in the long hole to move the roller between the first roller position and the second roller position.

9. An image forming apparatus comprising:

the fixing device according to claim 1; and an image forming section configured to form the toner image on the sheet.

* * * * *